United States Patent [19]

French

[11] 3,971,330

[45] July 27, 1976

[54] PROPULSION PUMP FOR WATER BORNE VESSELS

[75] Inventor: Neil S. French, Kodiak, Alaska

[73] Assignee: The Raymond Lee Organization, Inc., New York, N.Y. ; a part interest

[22] Filed: May 27, 1975

[21] Appl. No.: 580,800

[52] U.S. Cl. ..... 115/32

[51] Int. Cl.[2] ..... B63H 1/32

[58] Field of Search ..... 115/31–33, 115/21, 12 A, 29, 11, 70; 417/567, 569; 60/221, 222; 114/183 R, 184

[56] References Cited

UNITED STATES PATENTS

| | | | |
|---|---|---|---|
| 57,569 | 8/1866 | Raynale | 60/221 |
| 510,180 | 12/1893 | Lawless | 417/569 |
| 2,487,195 | 11/1949 | Stephens | 115/21 |
| 2,726,624 | 12/1955 | Raicy | 115/32 |
| 2,979,018 | 4/1961 | Birdsall | 115/32 |

*Primary Examiner*—Duane A. Reger
*Assistant Examiner*—Stuart M. Goldstein

[57] ABSTRACT

A vertically elongated pump has an intake port at its bottom and a rearwardly directed exhaust port near the bottom. A vertical rod is attached to a piston sliding inside the pump that sucks water in through the intake port and pushes it out the exhaust port. A butterfly valve opens and closes the intake port in cooperation with the motion of the piston. A clamp, attached to the front of the pump, detachably secures the pump to the side of a water borne vessel in a manner that the pump is free to rotate 180° about a vertical axis located outside the body of the pump. The rod is moved up and down by a manually operable handle that can rotate 360° around the vertical axis of the pump, and that can be locked at any position selected.

2 Claims, 2 Drawing Figures

PROPULSION PUMP FOR WATER BORNE VESSELS

SUMMARY OF THE INVENTION

The object of the invention is to provide a silent means of propulsion for water borne vessels such as canoes, rowboats and the like.

In this invention, a vertically elongated pump is detachably secured to the side of a water borne vessel. The pump is so constructed that it will intake water throgh an intake port located on the bottom of the pump and will expel the water through a rearwardly directed exhaust port. The pump is secured to the vessel in a manner that the pump is free to rotate 180° about a vertical axis that is outside the pump body, allowing the ejected water to be ejected forwardly for reverse motion or ejected sideways for oblique motion if such is needed.

If desired, the rod may be operated by a manually operable handle that can be rotated 360° about the vertical axis of the pump, and that can be locked at any position selected. With this feature, the user may adjust the handle to the position in which it is most comfortable to move up and down.

DETAILED DESCRIPTION OF PREFERRED EMBODIMENTS

Figure 1:
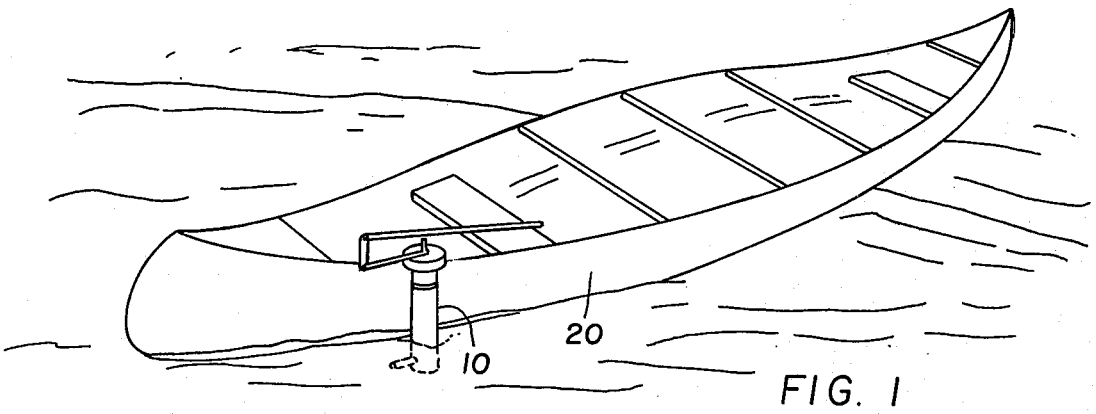
FIG. 1 shows the invention in use.
Figure 2:
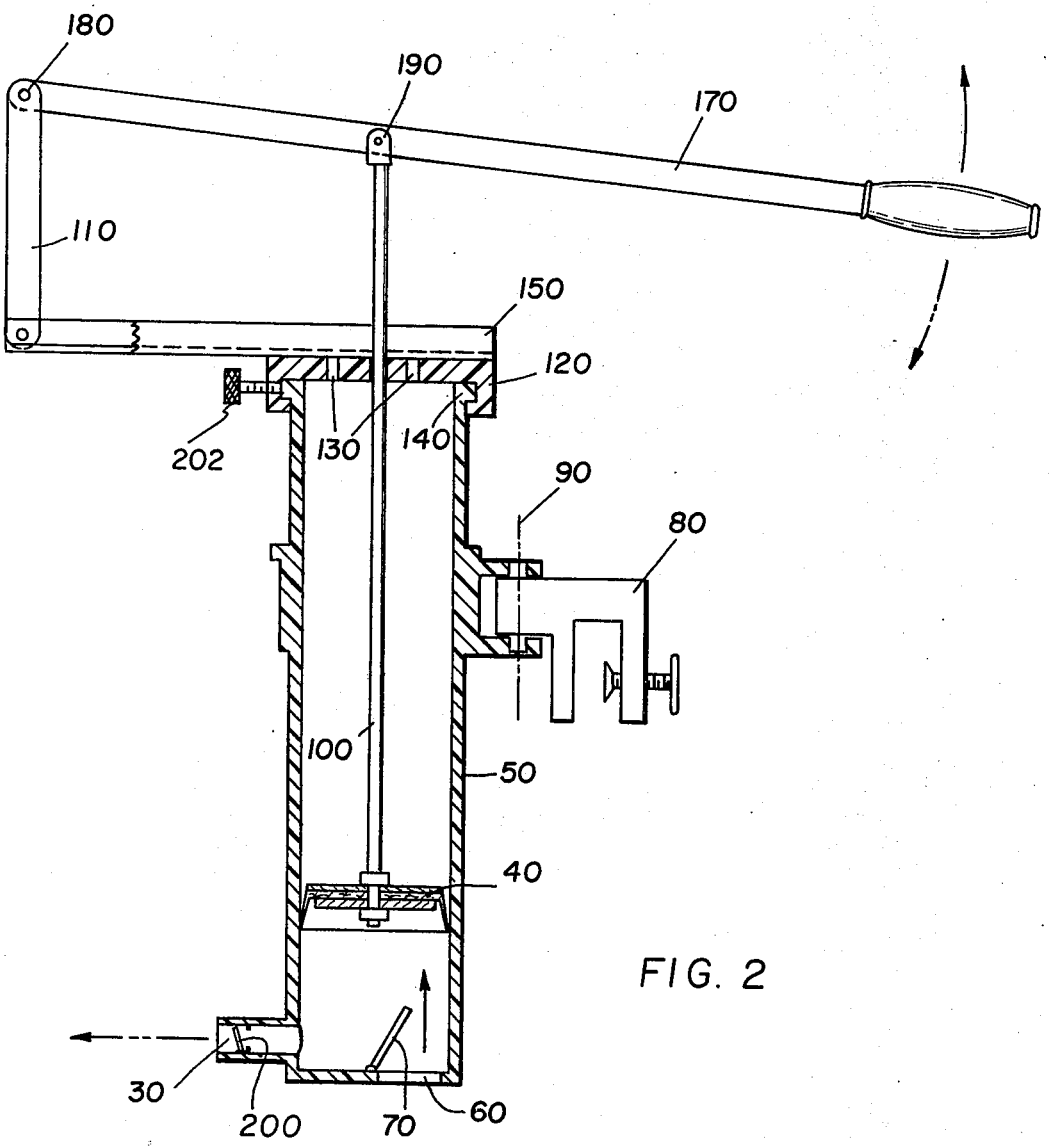
FIG. 2 shows a cross sectional view of the invention.

The invention, shown generally at 10 in FIG. 1, is attached to the side of a canoe 20. It propels the canoe forward by ejecting water through a rearwardly directed exhaust port 30 that generally resembles a conventional nozzle.

The invention operates by the upward and downward motion of a piston 40 inside a vertical, hollow, cylindrical housing 50. Water is sucked up through an intake port 60 past a pivoted butterfly valve 70 on the upstroke of the piston. On the downstroke of the piston, the valve shuts off the intake port and causes all the water in the device to be ejected through the exhaust port. A second pivoted butterfly valve 200 disposed in port 30 functions in opposite sense to valve 70, being opened when valve 70 is closed and vice versa.

The housing is detachably secured to the side of the vessel by clamp 80. The clamp is pivotally secured to the housing so as to allow the pump to be pivoted 180° about the vertical axis 90, allowing the exhaust port to be aimed so as to propel the vessel in the desired direction.

The piston is moved up and down by vertical rod 100. The rod extends through the center of a circular cap 120 that has air holes 130 to allow the piston to be moved freely up or down without compressing or expanding the air above it. The cap surrounds an annular lip 140 which is placed at the top of the housing, and which can be freely rotated thereon. An elongated horizontal member 150 is attached to the cap and supports a vertical member 110.

An elongated manually operable handle 170 is pivoted to member 110 and to the top of the rod by pivots 180 and 190, respectively. Because the end of the handle serves as a fulcrum and because the rod is attached to the handle intermediate its free ends, a second class lever is formed that gives the operator a mechanical advantage when the pump is operated by moving the handle up and down. When the device is to be used, the handle is rotated to the most convenient position, and nut 202 is tightened down, fixing the position of the cap with respect to the lip.

While the invention has been described with detailed reference to the drawings, the protection sought is to be limited only by the terms of the claims which follow.

I claim:

1. A manually operated pump device designed for attachment to and propulsion of water borne vessels, said device comprising:

a vertically elongated pump with an intake port at the bottom and a rearwardly directed exhaust port near the bottom, said pump being operable by an up-and-down motion of a vertical rod, said pump being provided with a first pivoted butterfly valve;

a piston operated by the rod, and cooperating with the first valve, the first valve opening and closing the intake port in cooperation with the up-and-down motion of the piston;

a handle attached to the top of the pump and operating rod, said handle being connected to the rod in a manner that a lever of the second class is formed, said handle being rotatable through a 360° arc and lockable at any position selected; and a clamp detachably securing the front of the pump to the side of a water borne vessel in a manner that the pump is free to rotate 180° about a vertical axis located outside the body of the pump.

2. The device of claim 1 wherein the pump is provided with a second pivoted butterfly valve to close and open the exhaust port in cooperation with the upward and downward motion of the piston.

* * * * *